United States Patent [19]

Peters

[11] Patent Number: 4,645,355

[45] Date of Patent: Feb. 24, 1987

[54] MOUNTING SYSTEM FOR CLOCK MECHANISM

[75] Inventor: Michael R. Peters, Germantown, Tenn.

[73] Assignee: Pearl Enterprises, Inc., Memphis, Tenn.

[21] Appl. No.: 756,720

[22] Filed: Jul. 19, 1985

[51] Int. Cl.[4] ..... G04B 37/00; G04B 29/00

[52] U.S. Cl. ..... 368/88; 368/300

[58] Field of Search ..... 368/76, 80, 88, 220, 368/223, 228, 236, 276, 297–300, 314–318

[56] References Cited

U.S. PATENT DOCUMENTS

| | | | |
|---|---|---|---|
| 352,715 | 11/1886 | Sandmark | 368/314 |
| 557,444 | 3/1896 | Smith | 368/300 |
| 566,587 | 8/1896 | Lane | 368/314 |
| 589,436 | 9/1897 | Ingraham | 368/314 |
| 707,430 | 8/1902 | Kuhn | 368/300 |
| 1,541,644 | 6/1925 | Herbermann | 368/300 |
| 1,766,806 | 6/1930 | Wilcox, Jr. | 368/300 |
| 2,041,342 | 5/1936 | Hogenbirk | 368/88 |
| 2,595,157 | 4/1952 | Mayer | 368/314 |

*Primary Examiner*—Vit W. Miska

*Attorney, Agent, or Firm*—Russell, Georges & Breneman

[57] ABSTRACT

A system for mounting a clock's working components and dial mechanism on a support platform to form a self-contained assembly which can be easily installed and removed from an enclosure. A clock movement supporting the working components is releasably supported from one side of a rigid, shaped mounting bracket for precise alignment with the dial mechanism which is releasably supported from the opposite side of the bracket by a plurality of dial posts. Attachment of the bracket to the dial panel mounts the movement and dial mechanism as a unit, and the dial panel is mounted on receiving fasteners for easy installation and removal. The bracket is fabricated to close tolerances to ensure alignment of critical components and consistent spacing between the movement and dial mechanism, and is sufficiently rigid to maintain these alignments and spacing and to sustain forces imposed upon the clock during handling and shipment.

20 Claims, 2 Drawing Figures

MOUNTING SYSTEM FOR CLOCK MECHANISM

BACKGROUND OF THE INVENTION

1. Field of the Invention

This invention relates generally to clocks, especially grandfather clocks, and more particularly to an improved system for supporting and mounting the working components of a clock within a cabinet.

2. The Prior Art

A technique commonly used to mount the clock's movement and dial in a cabinet or other enclosure involves the use of a support bracket, called a seatboard, on which the movement rests. Apertures, such as holes or grooves, are provided in the seatboard through which attachment screws extend to secure the movement to the seatboard. Occasionally additional support brackets may be provided which are fastened to the back of the clock cabinet. With this assembly technique, the major points of attachment are through the bottom of the seatboard and the clock movement. If the clock, such as a grandfather clock, is allowed to fall on its face during handling and shipment, the inertia of the clock frequently causes bending or breaking of the attachment screws. When this happens, the movement may press against the dial, causing damage to the dial and often bending of the hour shaft.

Even if other support brackets are used, because of the significant forces that are generated when the clock falls, there is generally some deflection of the clock dial. Additional brackets, in addition to creating a cluttered appearance within the cabinet, make it very difficult to install the movement and to remove for servicing. Even minor adjustments become very difficult due to the clutter of the seatboard and additional brackets that are frequently provided in a grandfather clock cabinet.

The structures and techniques presently used in the mounting of the clock movement and dial within the cabinet require many forms of fastening of the movement, dial, seatboard, etc., to various parts of the clock cabinet. These structures obstruct the view of the clock movement and dial, and hinder access for minor adjustments and servicing. Furthermore, the presently-used assembly techniques present a serious problem in the field servicing of the clock by making the movement and dial difficult to access and to remove for troubleshooting, cleaning and adjustments and repairs. Typically, in order for the service person to perform even the simplest repairs, numerous screws and mounting hardware must be removed and a number of components disassembled.

In the manufacture of grandfather clocks, one of two methods are commonly used to test the components in the assembly of the clock. There are problems associated with both techniques and at best they are inconvenient for the manufacturer. One method involves running the clock movement outside of the cabinet, with or without the dial attached, for a sufficient period of time to ensure proper working. Afterwards, the movement or the movement and dial assembly must be fitted within the cabinet, which could result in damage to the dial or possible misalignment of the movement and the dial, ultimately resulting in a failure.

A second method commonly used is to build the entire clock, including the cabinet, and test the grandfather clock as a complete unit standing upright in the factory. This results in rows of clock cabinets standing on the factory floor exposed to potential damage in the production area.

What is desirable, then, is a system for supporting and mounting the working components of a clock within a cabinet which will obviate the foregoing and related objections. Examples of the prior art are shown in the following U.S. Pat. Nos. 352,715, issued to Sandmark; 1,541,644, issued to Herbermann; 1,766,806, issued to Wilcox, Jr.; and 2,595,157, issued to Mayer. None of these patents, however, has satisfactorily addressed all the problems considered above.

SUMMARY OF THE INVENTION

Accordingly, one of the objects of the present invention is to provide a new and improved mounting and support system for the working components of a clock.

Another object of the invention is to provide a new and improved system for supporting and mounting the working components of a clock within an enclosure.

Another object is to provide a new and improved system of the foregoing type which will peremit the clock movement and dial to be able to sustain severe shocks which may be encountered during handling and shipment of a clock.

Yet another object of the present invention is to provide a system as above which will reduce the clutter and obstruction commonly found in the area of the clock movement and dial to afford a better view of and easier access to the mechanism for adjustments and repairs.

A further object of the present invention is to provide a system of the foregoing type which will permit easier and faster service in the field by making the movement and dial easily removable from the enclosure for adjustments, maintenance and repairs.

Still a further object of the present invention is to provide an improved technique for assembling and testing clock mechanisms to ensure trouble-free operation, and reliable and solid alignment of the movement with the dial.

These and other objects of the invention are achieved in a system for mounting the working components and dial assembly of a clock on a support platform to form a self-contained assembly which can be easily installed and removed from an enclosure. The dial panel constitutes the support platform on which a rigid, shaped mounting bracket is secured. The clock movement supporting the clock's working components is releasably supported form one side of the mounting bracket for precise meshing alignment with the dial assembly supported from the opposite side of the bracket.

The mounting bracket has a central, planar portion, with an opening to provide clearance for elements protruding from the clock movement, and angled end portions which position the central portion a fixed distance from the dial panel's surface. A plurality of spacing elements mount the dial assembly to the bracket, and latching members on the movement coact with these elements to releasably interconnect the movement, mounting bracket and dial assembly.

The mounting bracket is fabricated to close tolerances to ensure proper alignments of critical components and consistent spacing between the movement and the dial assembly, and is sufficiently rigid to maintain these alginments and spacing and to sustain forces imposed upon the clock during handling and shipping.

The dial panel is provided with a plurality of holes which receive threaded rods attached to the clock enclosure. Threaded fasteners, such as wing nuts, are used with the rods to permit easy installation and removal of the assembly.

The invention is described in greater detail by means of an illustrative embodiment and reference to the accompanying drawings.

DETAILED DESCRIPTION OF THE PREFERRED EMBODIMENT

Figure 1:
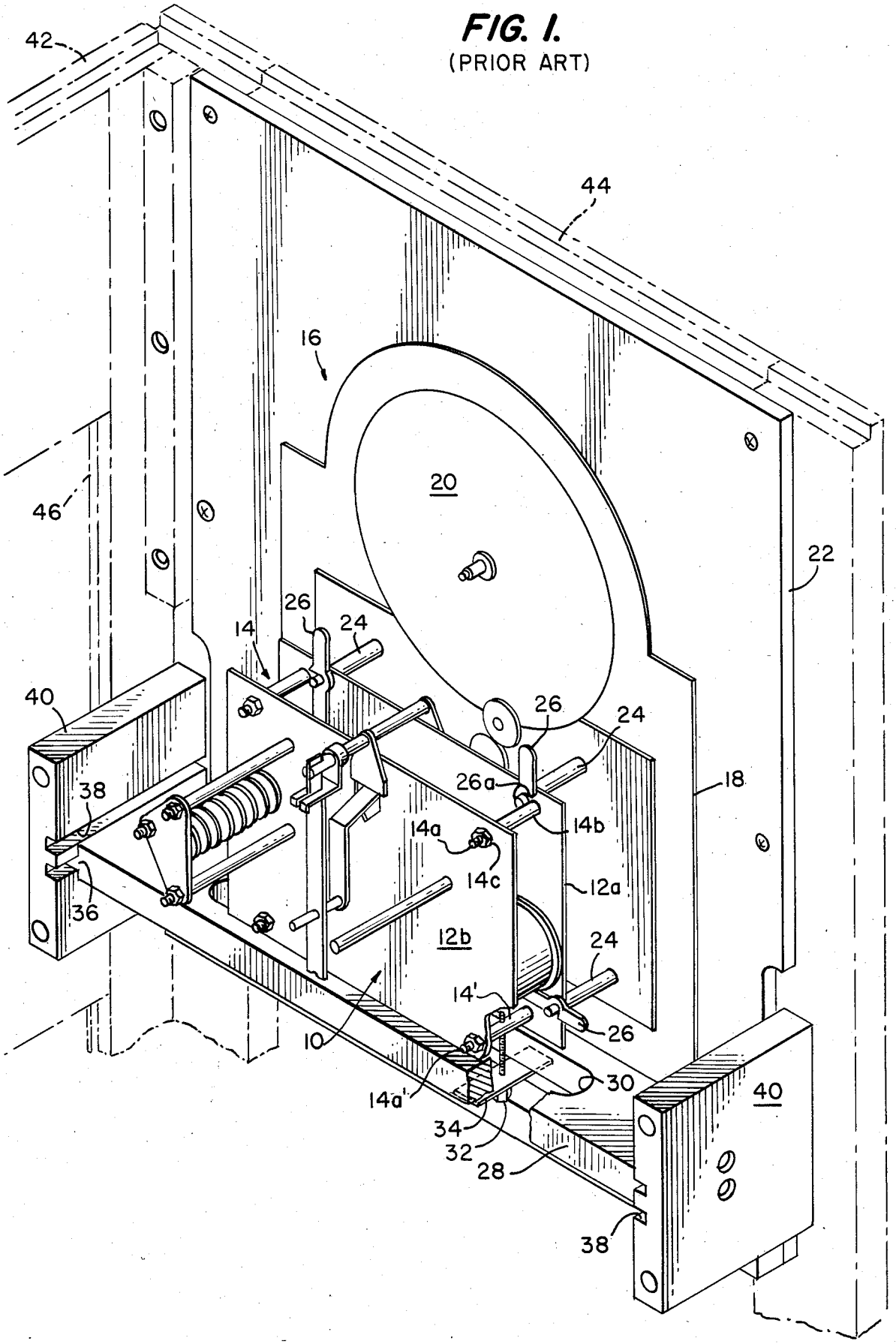
FIG. 1. (PRIOR ART)
FIG. 1 is a perspective view of a method rpesently used to support and mount a clock movement and dial within a clock cabinet.

Referring now to the drawings, shown in FIG. 1 is a technique presently used to suport and mount a clock movement and dial assembly within a clock cabinet. The clock movement, indicated generally by the reference numeral 10, comprises the mechanical gearing system commonly provided in a mechanically-operated clock, such as a grandfather clock illustrated in the present embodiment. Movement 10 includes a front plate 12*a* and a back plate 12*b* between which the gearing mechanism and other components of the movement are disposed. Movement plates 12*a, b* are assembled, properly spaced and secured by mounting fasteners 14, each of which includes a threaded fastener 14*a* passing through a tubular spacer or sleeve 14*b* and secured with a nut 14*c* on each end (one nut shown on each fastener in FIG. 1). Sleeves 14*b* provides the correct spacing or separation between the front plate 12*a* and back 12*b* to ensure proper alignment of the gears and other components forming the movement 10.

The dial assembly 16, or simply "dial", includes a face plate 18 and, in the stance of a grandfather clock, a moon dial 20, the dial being attached to and supported by a dial panel 22.

The assembled clock movement 10 is supported by and properly spaced from the dial 16 by four dial posts 24, each of which extends through an aperture provided adjacent to each of the four corners of the front plate 12*a*. The end of each dial post 24 which extends through the corresponding aperture in the front plate 12*a* is generally of a reduced diameter and provided with an annular groove (not visible in the drawings) which coacts with a locking lever or pin 26 pivotally attached to the back surface of the front plate. The locking lever 26 is provided with a notch or recess 26*a* which coacts with the dial post groove to removably but securely assemble the dial 16 and the clock movement 10. The remaining end of each dial post 24 is suitably secured to the dial 16.

As can be seen from FIG. 1, separation of the dial 16 and movement 10 can be achieved by rotating each locking lever 26 to disengage the notch 26*a* thereon from the annular groove on each of the dial posts 24. The larger-diameter portion of each dial post 24 provides the correct spacing between the front plate 12a and the back surface of the dial assembly 16.

By way of illustration, each dial post 24 may be formed from a length of bar stock, the ends of which have been turned down to a smaller diameter, with the annular groove also formed during this process. The length of the larger-diameter portion is established by the required spacing, or standoff, between the dial 16 and the front plate 12*a*. Alternatively, the dial post 24 may be embodied as a two-piece assembly, with a smaller-diameter rod, having an annular groove provided adjacent to one end portion, passing through a separate, larger outside diameter tubular sleeve forming the spacer. The other end of the rod would be suitably designed to attach to the dial 16.

A bracket, commonly known as a seatboard 28, is provided to support the movement 10 within the clock cabinet. Along the central portion of the length of the seatboard 28 is provided an aperture such as an elongated slot 30 shown in FIG. 1, or a series of separate holes or openings extending therethrough, through which two attachment screws 32 (one visible in FIG. 1) extend to secure the movement 10 onto the seatboard. As shown, each movement attachment screw 32 extends through a brace 34 extending transversely across the slot 30, to threadly engage an opening in each of the two lower movement mounting fasteners 14'. To facilitate use of the attachment screws 32, the lower fasteners 14' may be formed from a length of solid bar stock with the end portions turned down to a smaller diameter and threaded to form portion 14*a'* which receives nut 14*c*. The central, larger-diameter portion forms spacer 14*b'*, and at mid-length is provided with an internally-threaded hole extending diametrically therethrough to receive the attachment screw 32. Each of the upper fasteners 14 may also be formed from a length of solid bar stock, as is fastener 14', rather than being a two-piece assembly as described above.

Each end of the seatboard 28 may be provided with a tongue 36 which is slideably received within one of several grooves 38 provided in a seatboard mounting block 40, the latter being suitably attached to the side frame 42 of the clock cabinet. Several (two shown in FIG. 1) grooves 38 are spaced along the height of the mounting block 40 to permit vertical adjustment of the clock movement 10 within the cabinet.

The dial panel is secured to the cabinet's front frame 44 with a plurality of mounting screws or other suitable fasteners. A baffle opening 46 may be provided in each or both of the cabinet's side frames 42 to provide access to the interior of the cabinet.

All of the mechanisms and components of a complete clock assembly have not been shown in the drawings to enhance their clarity. Some of the elements shown have not been specifically described since these are knwon in the art. Similarly, the clock cabinet or enclosure is of known construction, and require no further description.

It is evident from the foregoing description that the techniques and devices presently used to install a clock movement and dial assembly within the cabinet involves numerous components and fastening hardware, requires considerable time in assembly, and generally obstructs the view and access to the clock movement. To gain access to the movement even for simple adjustments or minor repairs requires removal of several components and associated hardware, thus increasing the time and cost for such service. Should additional support brackets be provided, the foregoing problems are aggravated.

The Applicant has determined that in order to sustain a severe shock, the movement has to be supported at least on all four corners by a very rigid mounting structure. Specifically, it has been determined that the best points of attachment would be in conjunction with the dial posts which are generally supplied with the dial, and most clock movements are made to accommodate these posts through four holes in the front plate of the movement, with a locking pin or lever engaging the dial post on the back surface of the front plate, as described above.

Figure 2:
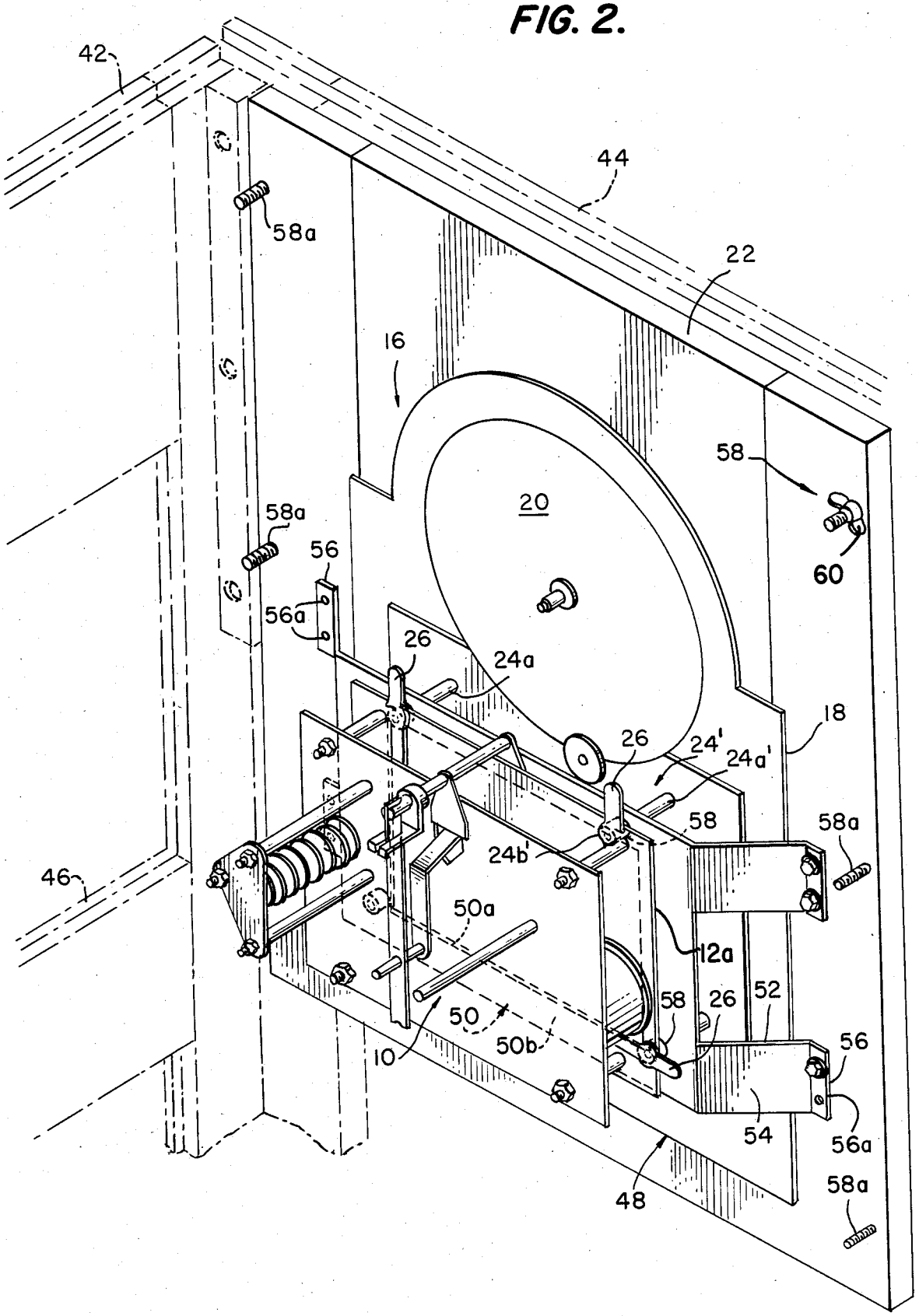
FIG. 2 is a perspective view showing the support and mounting system of the present invention.

FIG. 2 illustrates an embodiment of the improved mounting and support system of the present invention. Identical reference numerals have been used to identify the same components shown in FIGS. 1 and 2.

The improved mounting and support system of the present invention includes a mounting bracket 48 which provides support for both the clock movement 10 and the dial assembly 16, and provides a secure attachment for these components to the dial panel 22. The mounting bracket 48 includes a planar portion 50 from which a central cutout 50*a* has been removed therefrom to define a subtantially rectangularly bordering frame segment 50*b* of the bracket. Each end portion of the bracket 48 has a smaller cutout 52 to provide an integrally-formed pair of short tangs 54, each tang being bent at a predetermined angle relative to the plane of the bracket portion 50, with the free end portion of each tang formed with an angled tab 56. Each tab 56 has a pair of holes 56*a* to receive attachment fasteners. As shown in FIG. 2, the plane passing through the tabs 56 is substantially parallel with the plane of the bracket portion 50. The angle at which the tangs 54 are bent are determined principally by the clearance or distance required for the components of the dial assembly 16, when the bracket is securely attached to the back surface of the dial panel 22, as shown. The planar portion 50 is sized to provide an adequate support surface for the movement 10, and the cutout 50*a* is sized to provide an opening which clears the components customarily protruding from the front surface (as viewed from the front of the clock) of front plate 12*a*.

The cutouts 52 on each end of the mounting bracket 48 provides an opening which affords an unobstructed view of the intersection between the clock movement 10 and the dial 16. This permits the clock owner or service person a clear view of this intersection to verify that the movement is in fact properly engaged with the gear train of the moon dial located on the back surface of the dial 16. Additionally, the open space at the chime end of the bracket, or the end of the bracket which is adjacent to the chime mechanism of the movement, allows the mechanism free movement without obstruction.

To provide the requisite component clearances, each of the dial posts 24' has a larger-diameter spacer portion 24*a* extending between the back surface of dial 16 and the front surface of the bracket 48. The reduced-diameter portion 24*b'*, on the end of which is provided the annular groove, is somewhat longer than the corresponding portion 24*b* of the dial post 24 shown in FIG. 1 and extends through a bushing 58 fixed to the back surface of the bracket 48, and protrudes beyond the back surface of front plate 12*a*, to be engaged by the locking lever 26 in the manner described above. Bushings 58 provide the necessary clearance between the mounting bracket 48 and front plate 12*a*.

The mounting bracket 48 must be made to extremely close tolerances to ensure the proper alignments of the critical components and consistent spacing of the movement 10 relative to the cabinet and to the dial 16. The bracket must also be sufficiently rigid to maintain these alignments and spacing, and to be able to sustain the forces noted above which may exist during handling and shipment. A particularly suitable and very rigid mounting bracket has been fabricated by stamping the bracket from cold rolled steel, 0.104 inches (26.4 mm) thick, in a three-station, progressive die stamping operation on a punch press. Critical tolerances have been maintained in the stamping of the bracket. The relative spacing of the holes through which the dial posts protrude for attachment to the movement has been maintained within 0.002 inches (0.051 mm). The overall flatness of the bracket at the points of attachment has been held to within 0.010 inches (0.254 mm), and the height of the bracket, or the distance between the back of the dial panel and the furtherest surface of the bushings, has been maintained within 0.005 inches (0.127 mm).

By thorough testing under the most severe conditions, it has been established that the clock cabinet can be almost totally destroyed by dropping it from any direction inside a carton, or even unboxed, and still the clock movement and dial remain unscathed.

With the support bracket 48 of the present design, the obstructions commonly found in the area of the movement and the dial have been removed to afford a better view of the mechanism and provide easier access for adjustments and repairs. Use of the mounting bracket 48 eliminates the need for a seatboard which could interfere with the view of the mechanisms or the access for minor adjustments. Specifically, since the mounting bracket 48 interesects the movement 10 only from the front plate 12*a* forward, most adjustments can easily be made to the movement through the baffle opening 46 on either side of the clock. The mounting bracket 48 allows such free access that most minor repairs can be accomplished without dismounting the movement.

Also shown in FIG. 2 is another aspect of the present invention, wherein all components have been integrated into one easily removable sub-assembly, with the sub-assembly being the point of attachment to the cabinet. By attaching the dial assembly 16, the clock movement 10 and the mounting bracket 48 firmly to the dial panel 22, a complete assembly is provided which is totally self-contained, including all the mechanisms which normally would require repair work. To provide secure attachment of the dial panel 22 to the clock cabinet, and at the same time to permit easy removal of the sub-assembly, attachments commonly known as hanger bolts 58, which have wood screw threads on one end (not visible in FIG. 2) and machine screw threads on the other end 58*a*, are used to attach the dial panel. The wood screw threads of the hanger bolts 58 are threaded into the back surface of the cabinet front frame 44, leaving the machine screw thread portion 58*a* exposed and projecting into the interior of the cabinet. As shown, six of these hanger bolts 58 are used, three extending vertically along each side member of the fram 44. Holes are correspondingly provided along each edge of the dial panel 22 so that the entire sub-assembly can be placed over the protruding portions of the hanger bolts 56 and securely held with wing nuts 60.

To remove the entire sub-assembly, the six wing nuts 60 are removed, and the sub-assembly pulled from the cabinet.

Use of the mounting bracket 48 of the present invention, and the provision of the sub-assembly of the components mounted on the dial panel 22, and the attachment of the dial panel to the cabinet frame with hanger bolts 58 provide a technique for assemblying and testing the clock components of the clock movement 10, the dial assembly 16 and the mounting bracket 48, are built up or assembled separately, outside the clock cabinet, as a unit. The movement 10 and dial 16 are firmly fastened in place in their final position, with the dial tightly installed against the dial panel 22. This allows testing of the sub-assembly outside of the clock cabinet, but without the disadvantages of potential damage to the dial when the assembly is finally installed within the cabinet. Additionally, since all testing is performed with the sub-assembly as a unit, it is not necessary to have completely assembled grandfather clocks, with the cabinets, standing on the factory floor, where they may be exposed to potential damage in the production area. Instead, the complete sub-assembly is separately tested, and then only before packing is it mounted within the cabinet.

For greater clarity of the drawings, all required components have not been shown. It is understood that such components would be provided when necessary, and that all the components are arranged and supported in an operative fashion to form a complete and operative system.

The invention may be embodied in other specific forms without departing from the spirit or essential characteristics thereof. The present invention, therefore, is to be considered in all respects as illustrative and not restricted, the scope of the invention being indicated by the appended claims.

What is claimed is:

1. A system for mounting and supporting the working components and the dial mechanism of a clock as a selfcontained assembly, comprising:

a shaped mounting bracket having a substantially planar central portion and integrally-formed end portions angularly offset relative to said central portion;

a clock movement adapted to be removably mounted on one side of said central portion of the mounting bracket, said movement having the working components of the clock assembled as a unit and including means for releasably attaching the unit to the bracket;

a dial mechanism adapted to be mounted on the other side of the mounting bracket central portion, opposite from and in operative alignment with the clock movement;

means attached to the dial mechanism and coacting with the releasable attaching means of the clock movement for removably supporting the dial mechanism on the mounting bracket; and a platform on which the mounting bracket is attached by said end portions, with the movement and the dial mechanism supported on opposite sides of the bracket and detachable therefrom.

2. A system as defined in claim 1, wherein the supporting means for the dial mechanism include a plurality of elongated members, each attached at one end to the dial mechanism and having the other end adapted to be received by the mounting bracket, said members coacting with the releasing means on the movement to releasably interconnect the dial mechanism and movement with the bracket.

3. A system as defined in claim 2, wherein said releasing means comprises a plurality of latch elements, each pivotally supported by the movement, and the other end of each of said elongated members having an annular recess for cooperative engagement by respective latch elements.

4. A system as defined in claim 3, wherein each of said elongated elements has a spacer portion to provide a predetermined separation between the dial mechanism and the mounting bracket.

5. A system as defined in claim 3, wherein the central portion of the mounting bracket is apertured to provide clearance for working components projecting from the movement and to receive said elongated elements, and the bracket end portions are apertured to provide clearance and visual access to the operative interface between the dial mechanism and the movement.

6. A system as defined in claim 5, wherein said bracket is fabricated with close tolerances to ensure proper alignment between the movement and the dial mechanism and proper separation between components.

7. A system as defined in claim 6, wherein said bracket is fabricated of material sufficiently rigid to sustain forces imposed upon the self-contained assembly and clock, and to maintain proper alignment and separation.

8. A system as defined in claim 7, further comprising means for detachably mounting the platform within an enclosure.

9. A system as defined in claim 8, wherein said detachable mounting means includes a plurality of holes on said platform adapted to receive a corresponding plurality of fastening attachment means.

10. In combination with a clock housing, a clock movement comprising the clock's working components, and a dial assembly, a system for mounting the movement and assembly in the housing as a self-contained removable unit, comprising:

a shaped mounting bracket having a substantially planar central portion and integrally-formed end portions angularly offset relative to said central portion;

means for detachably mounting the dial assembly on one side of said central portion of the mounting bracket;

means on the clock movement cooperating with said mounting means to detachably mount the movement on the other side of the mounting bracket, opposite from and in operative alignment wtih the dial assembly; and a platform on which the mounting bracket is attached by said end portions, with the movement and dial assembly detachably mounted on opposite sides of the bracket, said platform constituting the dial panel for the clock.

11. A combination as defined in claim 10, wherein:

said detachable mounting means for the dial assembly include a plurality of elongated members, each member being attached at one end to the dial assembly and having an annular recess on the other end, and having a spacer portion to ensure that the dial assembly is supported from the mounting bracket at a predetermined separation, and said cooperating detaching means on said movement includes a plurality of latch elements pivotally connected to said movement to coact with the recess on respective elongated members to releasably interconnect the dial assembly and movement with the mounting bracket.

12. A combination as defined in claim 11, wherein the mounting bracket has a plurality of holes, corresponding in number to the number of elongated members, through which said elongated members extend for coaction with said latch elements.

13. A combination as defined in claim 12, further comprising a plurality of spacing elements on said bracket, positioned adjacent to said holes and through which said elongated members extend, to position said movement at a predetermined spacing from the bracket.

14. A combination as defined in claim 12, wherein the central portion of the mounting bracket is apertured to provide clearance for working components projecting from said movement and the end portions are apertured to provide clearance and visual access to the operative interface between said dial assembly and said movement.

15. A combination as defined in claim 14, wherein said bracket is formed with close tolerances to ensure proper alignment between the movement and the dial assembly, and is fabricated of material sufficiently rigid to sustain forces imposed upon the self-contained unit and the combination.

16. A combination as defined in claim 12, further comprising:

a plurality of threaded elements embedded in the clock housing;

a corresponding plurality of holes in the dial panel to receive said threaded elements; and a corresponding plurality of attachment means coacting with said threaded elements to removably secure the dial panel and self-contained unit in the housing.

17. A method for assemblying a clock having a clock movement constituting the working components of the clock, a dial assembly and an enclosure for housing the movement and the dial assembly, comprising:

supporting the movement and the dial assembly on a dial panel as a self-contained unit by providing a shaped mounting bracket having a substantially planar central portion and integrally-formed end portions angularly offset from said central portion, detachably mounting the clock movement and the dial assembly on opposite sides of said bracket central portion, in operative alignment, with respective mounting means provided on said clock movement and said dial mechanism, said mounting means cooperating with each other and with said bracket to achieve said detachable mounting of said movement and said mechanism, and securing said bracket on the dial panel; and removably attaching the dial panel to the housing enclosure with fastening means mounted in said enclosure.

18. A method as defined in claim 17, wherein the detachable mounting of the movement and dial assembly on the bracket comprises:

providing a plurality of elongated members, each attached at one end to the dial assembly and having an annular recess on the other end;

extending said elongated members through a corresponding plurality of holes in the bracket; and detachably mounting the movement on the bracket by engaging each of said elongated members with a corresponding plurality of latch elements pivotally supported on said movement.

19. A method as defined in claim 18, wherein the mounting bracket is formed with close tolerances to ensure proper alignment between the movement and the dial assembly, and is fabricated of material sufficiently rigid to sustain forces imposed upon the self-contained unit and the clock.

20. A method as defined in claim 19, further comprising:

providing spacing means on said elongated members to mount the dial assembly a predetermined distance from the bracket; and providing spacing means on said bracket to mount said movement a predetermined distance from the bracket.

* * * * *